US009899205B2

(12) United States Patent
Bezel et al.

(10) Patent No.: US 9,899,205 B2
(45) Date of Patent: *Feb. 20, 2018

(54) SYSTEM AND METHOD FOR INHIBITING VUV RADIATIVE EMISSION OF A LASER-SUSTAINED PLASMA SOURCE

(71) Applicant: KLA-Tencor Corporation, Milpitas, CA (US)

(72) Inventors: Ilya Bezel, Mountain View, CA (US); Kenneth P. Gross, San Carlos, CA (US); Lauren Wilson, San Jose, CA (US); Rahul Yadav, Sunnyvale, CA (US); Joshua Wittenberg, Fremont, CA (US); Aizaz Bhuiyan, Milpitas, CA (US); Anatoly Shchemelinin, Bozeman, MT (US); Anant Chimmalgi, San Jose, CA (US); Richard Solarz, Danville, CA (US)

(73) Assignee: KLA-Tencor Corporation, Milpitas, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/223,335

(22) Filed: Jul. 29, 2016

(65) Prior Publication Data

US 2017/0345639 A1 Nov. 30, 2017

Related U.S. Application Data

(60) Provisional application No. 62/341,532, filed on May 25, 2016.

(51) Int. Cl.

| | |
|---|---|
| ***H01J 61/12*** | (2006.01) |
| ***H01J 61/02*** | (2006.01) |
| ***H01J 61/36*** | (2006.01) |

(52) U.S. Cl.
CPC ..... *H01J 61/12* (2013.01); *H01J 61/025* (2013.01); *H01J 61/36* (2013.01)

(58) Field of Classification Search
CPC ..... H01J 61/12; H01J 61/025; H01J 61/36
(Continued)

(56) References Cited

U.S. PATENT DOCUMENTS

| | | | |
|---|---|---|---|
| 7,435,982 | B2 | 10/2008 | Smith |
| 7,786,455 | B2 | 8/2010 | Smith |

(Continued)

FOREIGN PATENT DOCUMENTS

| | | | |
|---|---|---|---|
| WO | 2010007015 | A1 | 1/2010 |

OTHER PUBLICATIONS

A. Schreiber et al., Radiation resistance of quartz glass for VUV discharge lamps, Journal of Physics D: Applied Physics, Aug. 19, 2005, p. 3242-3250, vol. 38, IOP Publishing Ltd, Printed in the UK.

*Primary Examiner* — Wyatt Stoffa
*Assistant Examiner* — Hanway Chang
(74) *Attorney, Agent, or Firm* — Suiter Swantz PC LLO

(57) ABSTRACT

A system for forming a laser-sustained plasma includes a gas containment element, an illumination source configured to generate pump illumination, and a collector element configured to focus the pump illumination from the pumping source into the volume of the gas mixture in order to generate a plasma within the volume of the gas mixture that emits broadband radiation. The gas containment element may be configured to contain a volume of a gas mixture including a first gas component and a second gas component. The second gas component suppresses at least one of a portion of the broadband radiation associated with the first gas component or radiation by one or more excimers associated with the first gas component from a spectrum of radiation exiting the gas mixture.

82 Claims, 9 Drawing Sheets

(58) Field of Classification Search
USPC ..... 250/493.1, 503.1, 504 R
See application file for complete search history.

(56) References Cited

U.S. PATENT DOCUMENTS

| | | | |
|---|---|---|---|
| 9,099,292 | B1 | 8/2015 | Bezel et al. |
| 9,185,788 | B2 | 11/2015 | Bezel et al. |
| 9,318,311 | B2 | 4/2016 | Chimmalgi et al. |
| 2007/0228300 | A1 | 10/2007 | Smith |
| 2013/0003384 | A1 | 1/2013 | Bezel et al. |
| 2013/0181565 | A1 | 7/2013 | Petro et al. |
| 2013/0342105 | A1 | 12/2013 | Shchemelinin et al. |
| 2014/0291546 | A1 | 10/2014 | Bezel et al. |
| 2015/0168847 | A1 | 6/2015 | Solarz et al. |
| 2016/0205758 | A1 | 7/2016 | Bezel et al. |
| 2016/0381776 | A1 | 12/2016 | Derstine et al. |

SYSTEM AND METHOD FOR INHIBITING VUV RADIATIVE EMISSION OF A LASER-SUSTAINED PLASMA SOURCE

CROSS-REFERENCE TO RELATED APPLICATION

The present application claims the benefit under 35 U.S.C. § 119(e) of U.S. Provisional Application Ser. No. 62/341,532, filed May 25, 2016, entitled REDUCING VUV EMISSIONS FROM LASER-SUSTAINED ARGON PLASMAS AND EXCIMERS THROUGH THE ADDITION OF XENON AND MERCURY, naming Ilya Bezel, Kenneth Gross, Lauren Wilson, Rahul Yadav, Joshua Wittenberg, Aizaz Bhuiyan, Anatoly Shchemelinin, Anant Chimmalgi, and Richard Solarz as inventors, which is incorporated herein by reference in the entirety.

TECHNICAL FIELD

The present disclosure relates generally to plasma-based light sources, and, more particularly, to laser-sustained plasma light sources with gas mixtures for inhibiting the emission of Vacuum Ultraviolet radiation from the plasma light source.

BACKGROUND

As the demand for integrated circuits having ever-smaller device features continues to increase, the need for improved illumination sources used for inspection of these ever-shrinking devices continues to grow. One such illumination source includes a laser-sustained plasma (LSP) source. Laser-sustained plasma (LSP) sources are capable of producing high-power broadband light. Laser-sustained plasma sources operate by focusing laser radiation into a gas mixture in order to excite the gas into a plasma state, which is capable of emitting light. This effect is typically referred to as "pumping" the plasma. However, broadband radiation emitted by the generated plasma may include one or more undesired wavelengths. For example, undesired wavelengths may be absorbed by elements such as, but not limited to, a transmission element, a reflective element, a focusing element, or components associated with the LSP light source. In some applications, the absorption of undesired wavelengths may lead to damage, degradation, or failure. Further, additional gas components may be introduced into the gas mixture to suppress undesired wavelengths. However, the additional gas components may themselves contribute to the emission of some undesired radiation. Therefore, it would be desirable to provide a system and method for curing defects such as those identified above.

SUMMARY

A system for forming a laser-sustained plasma is disclosed, in accordance with one or more illustrative embodiments of the present disclosure. In one illustrative embodiment, the system includes a gas containment element. In another illustrative embodiment, the gas containment element is configured to contain a volume of a gas mixture. In another illustrative embodiment, the gas mixture includes a first gas component and a second gas component. In another illustrative embodiment, the system includes an illumination source configured to generate pump illumination. In another illustrative embodiment, the system includes a collector element configured to focus the pump illumination from the pumping source into the volume of the gas mixture in order to generate a plasma within the volume of the gas mixture. In another illustrative embodiment, the plasma emits broadband radiation. In another illustrative embodiment, the second gas component suppresses at least one of a portion of the broadband radiation associated with the first gas component or radiation by one or more excimers associated with the first gas component from a spectrum of radiation exiting the gas mixture.

A plasma lamp for forming a laser-sustained plasma is disclosed, in accordance with one or more illustrative embodiments of the present disclosure. In one illustrative embodiment, the plasma lamp includes a gas containment element. In another illustrative embodiment, the gas containment element is configured to contain a volume of a gas mixture. In another illustrative embodiment, the gas mixture includes a first gas component and a second gas component. In another illustrative embodiment, the gas mixture is further configured to receive pump illumination in order to generate a plasma within the volume of the gas mixture. In another illustrative embodiment, the plasma emits broadband radiation. In another illustrative embodiment, the second gas component suppresses at least one of a portion of the broadband radiation associated with the first gas component or radiation by one or more excimers associated with the first gas component from a spectrum of radiation exiting the gas mixture.

A method for generating laser-sustained plasma radiation is disclosed in accordance with one or more illustrative embodiments of the present disclosure. In one illustrative embodiment, the method includes generating pump illumination. In another illustrative embodiment, the method includes containing a volume of a gas mixture within a gas containment structure. In another illustrative embodiment, the gas mixture includes a first gas component and a second gas component. In another illustrative embodiment, the method includes focusing at least a portion of the pump illumination to one or more focal spots within the volume of the gas mixture to sustain a plasma within the volume of the gas mixture. In another illustrative embodiment, the plasma emits broadband radiation. In another illustrative embodiment, the method includes suppressing the emission of at least one of a portion of the broadband radiation associated with the first gas component or radiation by one or more excimers associated with the first gas component from the spectrum of radiation exiting the gas mixture via the second gas component.

A plasma lamp for forming a laser-sustained plasma is disclosed in accordance with one or more illustrative embodiments of the present disclosure. In one illustrative embodiment, the plasma lamp includes a gas containment element. In another illustrative embodiment, the gas containment element is configured to contain a volume of a gas mixture. In another illustrative embodiment, the gas mixture includes argon and xenon. In another illustrative embodiment, the gas mixture is further configured to receive pump illumination in order to generate a plasma within the volume of the gas mixture. In another illustrative embodiment, the plasma emits broadband radiation. In another illustrative embodiment, the xenon of the gas mixture suppresses at least one of a portion of the broadband radiation associated with the argon of the gas mixture or radiation by one or more excimers associated with the argon of the gas mixture from a spectrum of radiation exiting the gas mixture.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF DRAWINGS

The numerous advantages of the disclosure may be better understood by those skilled in the art by reference to the accompanying figures in which.

DETAILED DESCRIPTION

Figure 1A:
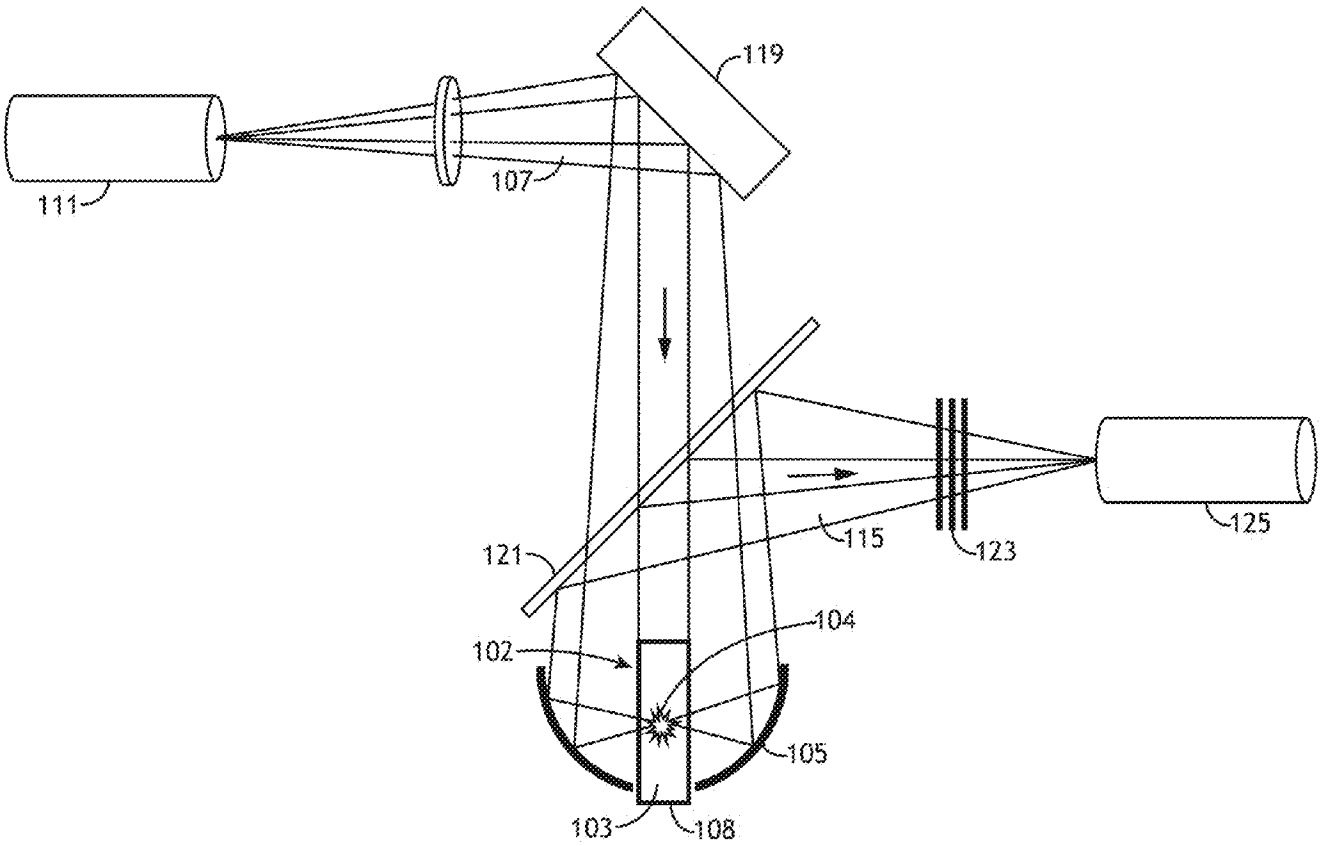
FIG. 1A is a conceptual view of a system for forming a laser-sustained plasma, in accordance with one embodiment of the present disclosure.

Reference will now be made in detail to the subject matter disclosed, which is illustrated in the accompanying drawings.

Referring generally to FIGS. 1A through 6, a system for generating a laser-sustained plasma is described in accordance with one or more embodiments of the present disclosure. Embodiments of the present disclosure are directed to a laser-sustained plasma source with a gas mixture designed to sustain a plasma that emits broadband light and simultaneously suppresses the emission of selected wavelengths. Embodiments of the present disclosure are directed to the incorporation of one or more gases into a gas mixture in a LSP source to selectively absorb emission of selected wavelengths of radiation emitted by the plasma. Additional embodiments of the present disclosure are directed to the incorporation of one or more gases into a gas mixture in a LSP source to quench emission of excimers in the gas mixture. Additional embodiments are directed to gas mixtures that produce light emission with high spectral intensity in ultraviolet, visible, and/or infrared spectral regions with limited brightness in undesirable spectral regions.

It is recognized herein that LSP light sources may utilize a wide range of components suitable for emitting broadband radiation when excited into a plasma state. Further, LSP sources may utilize certain components in much higher concentrations than alternative light sources (e.g. discharge light sources, or the like). For example, LSP light sources may utilize gas mixtures containing large concentrations of noble gases (e.g. argon, xenon, krypton, or the like) not practical for alternative light sources due to performance limitations (e.g. arcing considerations, or the like). In this regard, the composition of gas mixtures of LSP light sources may be selected based on the spectrum of emitted radiation.

It is further recognized herein that some gas components suitable for providing high spectral power within a desired spectral region (e.g. ultraviolet wavelengths, visible wavelengths, infrared wavelengths, or the like) may also provide high spectral power within an undesired spectral region (e.g. vacuum ultraviolet wavelengths (VUV), or the like). For example, LSP light sources including pure argon may produce a high total radiant power, but may produce intense VUV radiation that may damage components of the light source itself as well as additional components used to direct the broadband radiation generated by the light source. LSP light sources using xenon may provide moderate spectral power for desired spectral regions with less intense VUV radiation. However, the spectral power of a LSP light source including xenon in desired spectral regions may be relatively lower than the spectral power of a LSP light source including argon. Further, the production of VUV light may still negatively impact the light source or surrounding components.

In some applications, a LSP light source may utilize a mixture of gases in which a first gas component provides broadband illumination and one or more additional gas components suppress undesired wavelengths of radiation associated with the first gas component. However, the one or more additional gas components may introduce secondary effects and may contribute to the production of a non-negligible amount spectral power in undesired spectral regions. Accordingly, the net impact of the one or more additional gas components to reduce the spectral power of undesired wavelengths may be limited.

Further embodiments are directed to a LSP light source including a gas mixture with a first gas component associated with the generation of broadband radiation, a second gas component to suppress selected wavelengths of radiation associated with the first component, and a third gas component to suppress selected wavelengths of radiation associated with the first and/or the second gas components.

FIGS. 1A through 6 illustrate a system 100 for forming a laser-sustained plasma, in accordance with one or more embodiments of the present disclosure. The generation of plasma within inert gas species is generally described in U.S. Pat. No. 7,786,455, granted on Aug. 31, 2010; and U.S. Pat. No. 7,435,982, granted on Oct. 14, 2008, which are incorporated herein by reference in their entirety. Various plasma cell designs and plasma control mechanisms are described in U.S. Pat. No. 9,318,311, granted on Apr. 19, 2016, which is incorporated herein by reference in the entirety. The generation of plasma is also generally described in U.S. Patent Publication No. 2014/0291546, published on Oct. 2, 2014, which is incorporated by reference herein in the entirety. Plasma cell and control mechanisms are also described in U.S. patent application Ser. No. 14/231,196, filed on Mar. 31, 2014, which is incorporated by reference herein in the entirety. Plasma cell and control mechanisms are also described in U.S. Pat. No. 9,185,788, granted on Nov. 10, 2015, which is incorporated by reference herein in the entirety. Plasma cell and control mechanisms are also described in U.S. Patent Publication No. 2013/0181595, published on Jun. 18, 2013, which is incorporated by reference herein in the entirety. The use of gas mixtures to inhibit radiative emission of a plasma light source are generally described in U.S. patent application Ser. No. 14/989,348, filed on Jan. 6, 2016, which is incorporated herein by reference in the entirety. In a general sense, the system 100 should be interpreted to extend to any plasma based light source known in the art.

Referring to FIG. 1A, in one embodiment, the system 100 includes an illumination source 111 (e.g., one or more lasers) configured to generate pump illumination 107 of a selected wavelength, or wavelength range, such as, but not limited to, infrared radiation or visible radiation. In another embodiment, the system 100 includes a gas containment structure 102 (e.g. for generating, or maintaining, a plasma 104). The gas containment structure 102 may include, but is not limited to, a plasma cell (see FIG. 1B), a plasma bulb (see FIG. 1C), or a chamber (see FIG. 1D). Focusing pump illumination 107 from the illumination source 111 into the volume of a gas mixture 103 may cause energy to be absorbed through one or more selected absorption lines of the gas mixture 103 or plasma 104 within the gas containment structure 102, thereby "pumping" the gas species in order to generate or sustain a plasma 104. In another embodiment, although not shown, the gas containment structure 102 may include a set of electrodes for initiating the plasma 104 within the internal volume of the gas containment structure 102, whereby the pump illumination 107 from the illumination source 111 maintains the plasma 104 after ignition by the electrodes. Further, the plasma 104 may emit broadband radiation upon relaxation of gas species to a lower energy level.

In another embodiment, excimers may form within the volume of gas outside of the generated plasma 104 at temperatures suitable for generating and/or maintaining a bound excimer state (e.g. a bound molecular state associated with one or more components of the gas mixture 103) representing an excited energy state of the molecule. Excimers may emit radiation in the ultraviolet spectrum upon relaxation (e.g. de-excitation, or the like) to a lower energy state of the excimer. In some embodiments, de-excitation of an excimer may result in a dissociation of the excimer molecule. For example, Ar2* excimers may emit at 126 nm, Kr2* excimers may emit at 146 nm, and Xe2* excimers may emit at 172 nm or 175 nm. It is noted that the spectral content of radiation emanating from the gas containment structure 102 may include spectral components associated with emission from the plasma 104 and/or one or more excimers within the gas containment structure 102.

In another embodiment, the system 100 includes a collector element 105 (e.g., an ellipsoidal or a spherical collector element) configured to focus illumination emanating from the illumination source 111 into a volume of a gas mixture 103 contained within the gas containment structure 102. In another embodiment, the collector element 105 is arranged to collect broadband radiation 115 emitted by plasma 104 and direct the broadband radiation 115 to one or more additional optical elements (e.g., filter 123, homogenizer 125, and the like). It is noted that the above configuration is not a limitation on the scope of the present disclosure. For example, the system 100 may include one or more reflector and/or focus optics for focusing and/or directing pump illumination 107 from illumination source 111 into the volume of the gas mixture 103 and a separate set of collection optics for collecting broadband radiation 115 emitted by the plasma 104. For example, an optical configuration including separate reflector optics and collection optics is described in U.S. application Ser. No. 15/187,590, filed on Jun. 20, 2016, which is incorporated herein by reference in the entirety.

In another embodiment, the gas containment structure 102 includes one or more transparent portions 108 configured to transmit pump illumination 107 into the gas containment structure 102 and/or transmit broadband radiation 115 from the gas mixture 103 outside of the gas containment structure 102.

In another embodiment, the system 100 includes one or more propagation elements configured to direct and/or process light emitted from the gas containment structure 102. For example the one or more propagation elements may include, but are not limited to, transmissive elements (e.g. transparent portions 108 of the gas containment structure 102, one or more filters 123, and the like), reflective elements (e.g. the collector element 105, mirrors to direct the broadband radiation 115, and the like), or focusing elements (e.g. lenses, focusing mirrors, and the like).

It is noted herein that broadband radiation 115 of plasma light is generally influenced by a multitude of factors including, but not limited to, the focused intensity of pump illumination 107 from the illumination source 111, the temperature of the gas mixture 103, the pressure of the gas mixture 103, and/or the composition of the gas mixture 103. Further, spectral content of broadband radiation 115 emitted by the plasma 104 and/or the gas mixture 103 (e.g. one or more excimers within the gas containment structure 102) may include, but is not limited to, infrared (IR), visible, ultraviolet (UV), vacuum ultraviolet (VUV), deep ultraviolet (DUV), or extreme ultraviolet (EUV) wavelengths. In one embodiment, the plasma 104 emits visible and IR radiation with wavelengths in at least the range of 600 to 1000 nm. In another embodiment, the plasma 104 emits visible and UV radiation with wavelengths in at least the range of 200 to 600 nm. In another embodiment, the plasma 104 emits at least short-wavelength radiation having a wavelength below 200 nm. In a further embodiment, one or more excimers in the gas containment structure 102 emit UV and/or VUV radiation. It is noted herein that the present disclosure is not limited to the wavelength ranges described above and the plasma 104 and/or excimers in the gas containment structure 102 may emit light having wavelengths in one or any combination of the ranges provided above.

In certain applications, only a portion of the spectral content of broadband radiation 115 emitted by the plasma 104 and/or one or more excimers within the gas containment structure 102 is desired. In some embodiments, the gas mixture 103 contained within the gas containment structure 102 suppresses the emission of one or more select wavelengths of radiation from the gas containment structure 102. For example, the gas mixture 103 may quench or otherwise prevent the emission of one or more wavelengths of radiation from the plasma 104 and/or one or more excimers in the gas containment structure 102. By way of another example, the gas mixture 103 may absorb select wavelengths of radiation emitted by the plasma 104 and/or one or more excimers prior to the transparent portions 108 of the gas containment structure 102. In this regard, one or more components of the gas mixture 103 serve to selectively reduce the spectral power of undesired wavelengths of radiation generated by the plasma 104 and/or the excimers emanating from the gas containment structure 102.

An LSP light source in which undesired wavelengths have been suppressed by the gas mixture 103 may be generally useful for tailoring the output of the light source. In this regard, one measure of performance for a light source in a given application may be the ratio of the spectral power for desired spectral regions relative to the total spectral power of the LSP source. In this regard, performance of the LSP light source may be improved by increasing the spectral power for desired spectral regions relative to the spectral power of undesired spectral regions. In one embodiment, the gas containment structure 102 contains a gas mixture 103 that suppresses the emission of undesired wavelengths of radiation emitted from the gas containment structure 102 to diminish the spectral power of undesired wavelengths and thereby improve performance of the LSP source. Further, the use of a gas mixture 103 with one or more gas components configured to suppress undesired wavelengths may enable a wider range of suitable gases for LSP light sources. For example, a plasma 104 generated in an identified gas may exhibit high spectral power for wavelengths in a desired spectral region, but may be impractical due to problematic spectral power for wavelengths in undesired spectral regions. In one embodiment, the high spectral power for wavelengths in desired spectral regions may be utilized by adding one or more gas components to the identified gas to generate a gas mixture 103 in which wavelengths in undesired spectral wavelengths are inhibited.

In another embodiment, the gas containment structure 102 contains a gas mixture 103 that inhibits the emission of undesired wavelengths of radiation corresponding to absorption bands of one or more components of the system 100. The one or more components of the system 100 may include, but are not limited to, one or more propagation elements in the system 100 or one or more elements beyond the system 100. As previously noted, the one or more propagation elements may include, but are not limited to, one or more transmissive elements (e.g. a transparent portion 108 of the gas containment structure 102, one or more filters 123, and the like), one more reflective elements (e.g. the collector element 105, mirrors to direct the broadband radiation 115, and the like), or one or more focusing elements (e.g. lenses, focusing mirrors, and the like) For example, applications utilizing a LSP source for the generation of visible and/or infrared radiation may include optical components sensitive to smaller wavelength radiation including, but not limited to, UV, VUV, DUV, or EUV radiation. It is noted herein that many optical components (e.g. transparent portions 108 of the gas containment structure 102, lenses, mirrors, and the like) configured for visible and/or infrared illumination may absorb shorter smaller wavelength radiation, which may lead to heating, degradation, or damage of the element. In some cases, absorption of radiation within a transparent portion 108 of the gas containment structure 102 or additional optical elements in the system induces solarization that limits the performance and/or operational lifespan of the component. As another example, one or more components of the system 100 may be sensitive to select wavelengths within visible or infrared spectral regions.

Inhibiting radiation using the gas mixture 103 contained in the gas containment structure 102 may mitigate potential incubation effects associated with long term-exposure to undesired wavelengths of radiation. In one embodiment, gas mixture 103 is circulated in the gas containment structure 102 (e.g. by natural or forced circulation) such that incubation effects associated with continued exposure to radiation emitted by the plasma 104 are avoided. For example, circulation may mitigate modifications of the temperature, pressure, or species within the gas mixture 103 that may impact the emission of radiation from the gas containment structure 102.

In one embodiment, the gas mixture 103 contained within the gas containment structure 102 simultaneously sustains the plasma 104 and suppresses the emission of one or more select undesired wavelengths of radiation from the gas containment structure 102. It is noted herein that the relative concentrations of gas components within the gas mixture 103 may impact both the spectrum of broadband radiation 115 emitted by the plasma 104 as well as the spectrum of radiation inhibited by the gas mixture 103. In this regard, the spectrum of broadband radiation 115 emitted by the plasma and the spectrum of radiation inhibited (e.g., absorbed, quenched, or the like) by the gas mixture 103 may be adjusted by controlling the relative composition of gas components within the gas mixture 103.

In one embodiment, the gas mixture 103 contained within the gas containment structure 102 absorbs one or more selected wavelengths of radiation emitted by the plasma 104 (e.g. VUV radiation emitted by the plasma 104, emission associated with one or more excimers in the gas containment structure 102, or the like). For example, a plasma 104 containing excited species of a first component of the gas mixture 103 may emit radiation that is absorbed by one or more additional gas components within the gas containment structure 102. In this regard, undesired wavelengths of radiation may be inhibited from impinging on the transparent portion 108 of the gas containment structure 102 and thus exiting the gas containment structure 102.

Figure 2:
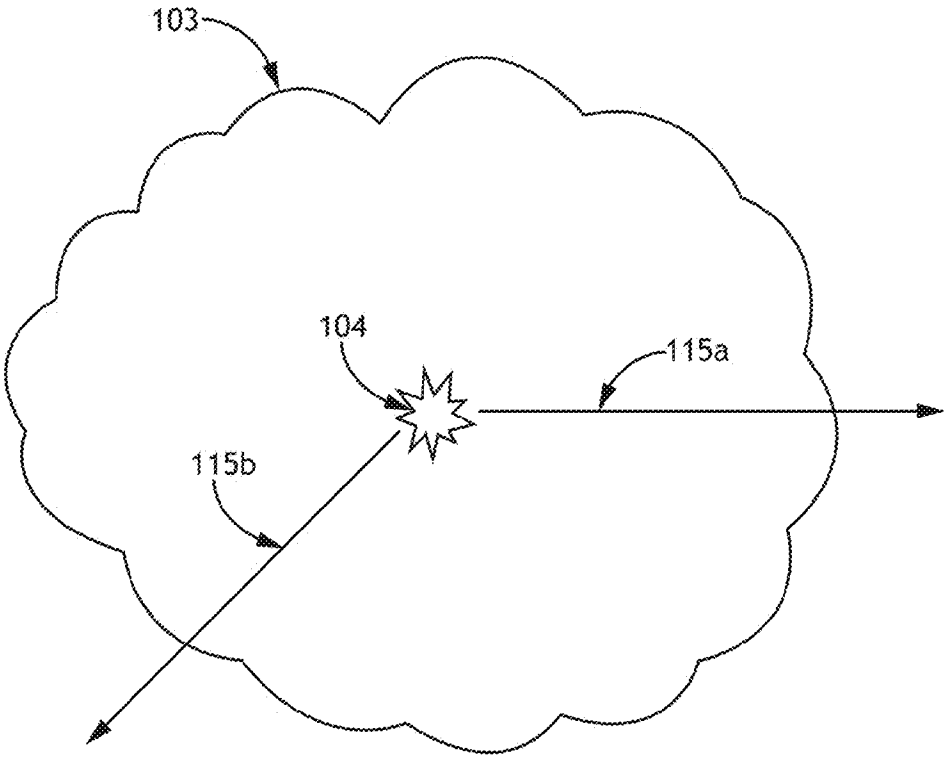
FIG. 2 is a conceptual diagram illustrating a plasma formed within a volume of a gas mixture, in accordance with one embodiment of the present disclosure.

FIG. 2 is a simplified diagram illustrating the plasma 104 within a volume of the gas mixture 103 in which selected wavelengths of radiation emitted by the plasma 104 are absorbed by the gas mixture 103, in accordance with one or more embodiments of the present disclosure. In one embodiment, broadband radiation 115*a*, 115*b* is emitted by the plasma 104. In another embodiment, the gas containment structure 102 is configured such that the size of the plasma 104 is substantially smaller than the size of the surrounding gas mixture 103. As a result, broadband radiation 115*a*, 115*b* emitted by the plasma 104 propagates through a distance of gas substantially larger than the size of the plasma 104. For example, the gas containment structure 102 may be configured such that extent of the gas mixture 103 is a factor of two or more times the size of the plasma 104. By way of another example, the gas containment structure 102 may be configured such that size of the gas mixture 103 is one or more orders of magnitude larger than the size of the plasma 104.

In another embodiment, one or more gas components of the gas mixture 103 selectively absorb one or more selected wavelengths of broadband radiation 115*a* emitted by the plasma such that the intensities of the one or more selected wavelengths of broadband radiation 115*a* are attenuated during propagation through the volume of the gas mixture 103. It is noted herein that the degree to which the one or more selected wavelengths of broadband radiation 115*a* are absorbed may be related at least in part to the strength of absorption by the gas mixture 103 at the one or more selected wavelengths as well as the distance the broadband radiation 115*a* propagates through the gas mixture 103. In this regard, the same total attenuation may be achieved by a relatively strong absorption of the one or more selected wavelengths over a short propagation distance or a relatively weak absorption of the one or more selected wavelengths over a longer propagation distance.

In another embodiment, the gas mixture 103 is transparent to one or more additional wavelengths of broadband radiation 115*b* emitted by the plasma 104 such that the spectral powers of the one or more additional wavelengths of broadband radiation 115*b* are not attenuated during propagation through the volume of the gas mixture 103. Consequently, the gas mixture 103 may selectively filter one or more selected wavelengths of the broadband radiation spectrum of broadband radiation 115 emitted by the plasma 104.

It is contemplated herein that the system 100 may be utilized to initiate and/or sustain a plasma 104 using a variety of gas mixtures 103. In one embodiment, the gas mixture 103 used to initiate and/or maintain the plasma 104 may include a noble gas, an inert gas (e.g., noble gas or non-noble gas) and/or a non-inert gas (e.g., mercury). In another embodiment, the gas mixture 103 includes a mixture of a gas (e.g., noble gas, non-noble gases and the like) and one or more gaseous trace materials (e.g., metal halides, transition metals and the like). For example, gases suitable for implementation in the present disclosure may include, but are not limited, to Xe, Ar, Ne, Kr, He, N2, H2O, O2, H2, D2, F2, CH4, metal halides, halogens, Hg, Cd, Zn, Sn, Ga, Fe, Li, Na, K, TI, In, Dy, Ho, Tm, ArXe, ArHg, ArKr, ArRn, KrHg, XeHg, and the like. In a general sense, the present disclosure should be interpreted to extend to any LSP system and any type of gas mixture 103 suitable for sustaining a plasma 104 within a gas containment structure 102.

In one embodiment, the gas mixture 103 contained within the gas containment structure 102 includes a first gas component and at least a second gas component configured to suppress radiation associated with the first gas component. For example, the second gas component may suppress radiation emitted by a plasma 104 formed at least in part from species of the first gas component. By way of another example, the second gas component may suppress radiation emitted by one or more excimers formed at least in part from species of the first gas component.

In another embodiment, the gas mixture 103 contained within the gas containment structure 102 includes argon mixed with a noble gas (e.g. xenon, krypton, neon, radon, or the like). It is noted that the addition of krypton, xenon and/or radon may serve to suppress (e.g. absorb, or the like) radiation emitted by the plasma 104 in a selected wavelength region (e.g. VUV radiation). For example, the gas mixture 103 contained within the gas containment structure 102 may include, but is not limited to, argon with a partial pressure of 10 atm and xenon with a partial pressure of 2 atm. Further, a gas mixture 103 including argon and a small concentration of xenon may include a pressure-broadened absorption band in the range of 145-150 nm and broad absorption for wavelengths shorter than 130 nm due at least in part to ground state absorption of light by the gas mixture 103.

In another embodiment, the gas mixture 103 contained within the gas containment structure 102 includes one or more gas components configured to quench the emission of excimers in the gas mixture 103. It is noted herein that the gas mixture 103 may include any gas component known in the art suitable to quench excimer emission. The gas mixture 103 may include one or more gas components suitable for quenching emission from any type of excimer known in the art including, but not limited to, homonuclear excimers of rare gas species, heteronuclear excimers of rare gas species, homonuclear excimers of one or more non-rare gas species, or heteronuclear excimers of one or more non-rare gas species. It is further noted that temperatures low enough to support bound excimer states may also support molecular species as well as atomic species to quench excimer emission. For example, the gas mixture 103 may contain, but is not limited to, $O_2$, $N_2$, $CO_2$, $H_2O$, $SF_6$, $I_2$, $Br_2$, or Hg to quench excimer emission. Additionally, the gas mixture 103 contained in the gas containment structure 102 may include one or more gas components typically unsuitable for use in alternative light sources. For example, the gas mixture 103 may include gases such as, but not limited to, $N_2$ and $O_2$, which are typically not used in arc lamps as these gases may degrade components, such as, but not limited to, electrodes.

It is further noted herein that one or more gas components of a gas mixture 103 may quench excimer emission through any pathway known in the art. For example, one or more gas components of a gas mixture 103 may, but are not limited to, quench excimer emission via collisional dissociation, photolytic processes, or a resonant energy transfer (e.g. resonance excitation transfer, or the like). Additionally, one or more gas components of a gas mixture 103 may quench excimer emission through absorption of radiation emitted by excimers within the gas mixture 103.

In one embodiment, the gas mixture 103 contained in the gas containment structure 102 includes xenon and at least one of Hg, $O_2$, or $N_2$ to quench emission from $Xe_2$* excimers generated in the gas mixture 103. In another embodiment, the gas mixture 103 contained in the gas containment structure 102 includes argon and at least one of xenon or $N_2$ to quench emission from $Ar_2$* excimers generated in the gas mixture 103. In another embodiment, the gas mixture 103 contained in the gas containment structure 102 includes neon and $H_2$ to quench emission from $Ne_2$* excimers generated in the gas mixture 103.

Figure 3:
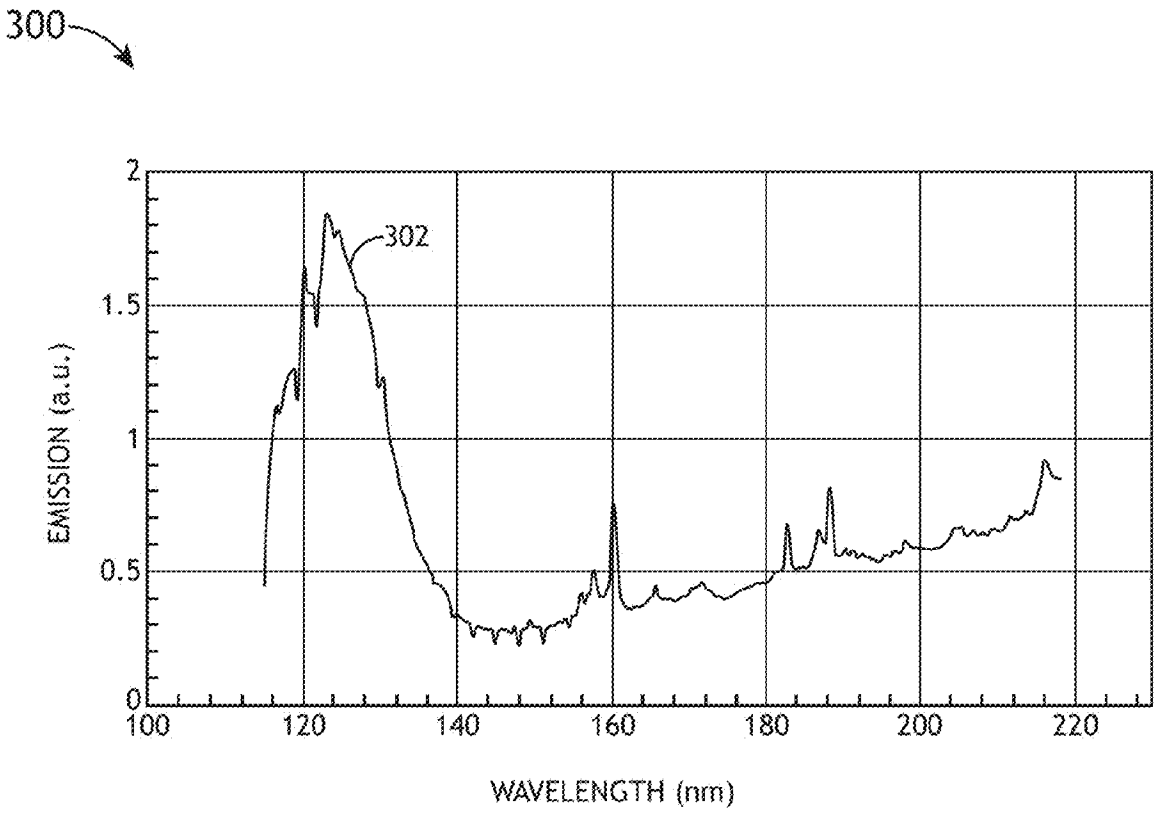
FIG. 3 is a plot illustrating the emission spectrum of a gas containment structure containing pure argon, in accordance with one or more embodiments of the present disclosure.

FIG. 3 is a plot 300 illustrating the emission spectrum 302 of a gas containment structure 102 containing pure argon, in accordance with one or more embodiments of the present disclosure. In one embodiment, an emission spectrum 302 of a gas containment structure 102 containing pure argon includes substantial emission of wavelengths lower than 140 nm (e.g. VUV wavelengths, or the like). Further, the emission spectrum 302 includes radiation associated with an excimer (e.g. $Ar_2$*, or the like) at a peak around 126 nm.

Figure 4:
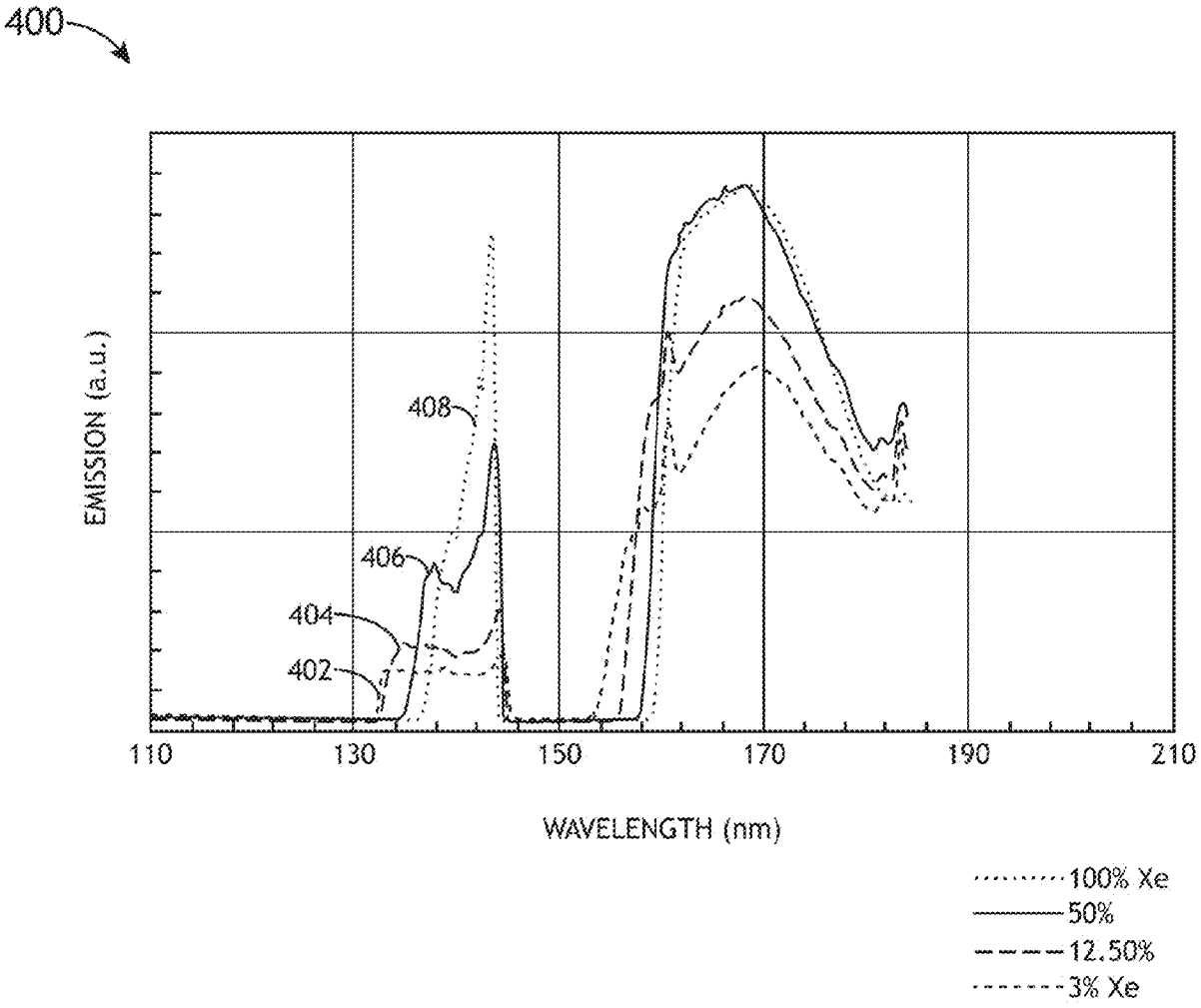
FIG. 4 is a plot illustrating the emission spectra of gas containment structures containing various mixtures of argon and xenon, in accordance with one or more embodiments of the present disclosure.

FIG. 4 is a plot 400 illustrating the emission spectra of gas containment structures 102 containing various mixtures of argon and xenon, in accordance with one or more embodiments of the present disclosure. In one embodiment, plot 402 illustrates the emission spectrum of a gas containment structure 102 including 97% argon and 3% xenon. In another embodiment, plot 404 illustrates the emission spectrum of a gas containment structure 102 including 87.5% argon and 12.5% xenon. In another embodiment, plot 406 illustrates the emission spectrum of a gas containment structure 102 including 50% argon and 50% xenon. In another embodiment, plot 408 illustrates the emission spectrum of a gas containment structure 102 including pure xenon.

In this regard, the xenon of the gas mixture may suppress selected wavelengths of emission associated with the argon of the gas mixture 103. For example, the xenon of the gas mixture 103 may suppress and/or eliminate the $Ar_2$* excimer peak at 126 nm. Further, the xenon of the gas mixture 103 may suppress select broadband radiation 115 (e.g. VUV radiation, or the like) associated with a plasma 104 formed at least in part by the argon of the gas mixture 103. Additionally, a relatively small percentage of xenon such as, but not limited to, less than 5%, may suppress the selected wavelengths of emission. For example, plot 402 illustrates the emission spectrum of a gas containment structure 102 including 97% argon and 3% xenon exhibits substantially reduced emission in the spectral region between 130 and 150 nm (e.g. associated with radiation by a plasma 104 and/or one or more excimers) relative to a gas containment structure 102 containing pure argon (see FIG. 3).

It is noted herein that a gas component configured to suppress selected wavelengths of radiation associated with additional gas components of a gas mixture 103 may additionally contribute to the total spectrum of radiation emanating from the gas mixture 103. For example, xenon configured to suppress radiation associated with argon in a gas mixture 103 (e.g. radiation associated with a plasma 104 and/or excimers containing argon) may additionally emit radiation. In one instance, xenon of the gas mixture 103 may be excited (e.g. by the pump illumination 107) as a part of the plasma 104 and emit broadband radiation 115 including, but not limited to VUV radiation. In another instance, xenon of the gas mixture may form excimers that emit radiation (e.g. $Xe_2$* excimers emitting at 172 nm, 175 nm, or the like). Plots 402-408 of FIG. 4 illustrate increasing spectral powers of radiation for wavelengths below 190 nm associated with xenon for increasing concentrations of xenon in the gas mixture 103.

In another embodiment, the gas mixture 103 includes three gas components. For example, the gas mixture 103 may include a first gas component configured to provide broadband radiation for the system 100 (e.g. through the formation of a plasma 104, the generation of one or more excimers, or the like). Further, the gas mixture 103 may include a second gas component to suppress one or more selected wavelengths associated with the first gas component. For example, the second gas component may, but is not limited to, absorb one or more wavelengths emitted by a plasma 104 formed at least in part from species of the first gas component. As another example, the second gas component may quench emission from excimers formed at least in part from species of the first gas component. Additionally, the gas mixture 103 may include a third gas component to suppress select wavelengths of radiation associated with the first gas component and/or the second gas component (e.g. radiation emitted by a plasma 104 and/or excimers formed at least in part from the first and/or the second gas components).

In one instance, the gas mixture 103 includes mercury to suppress select wavelengths of radiation associated with xenon. For example, relatively small concentrations of mercury (e.g. less than 5 mg/cc) may suppress the spectral power radiation from Xe2* excimers around 172 nm and/or 175 nm. Further, mercury may suppress broadband radiation (e.g. VUV radiation, or the like) emitted by a plasma 104 formed at least in part from xenon.

Figure 5:
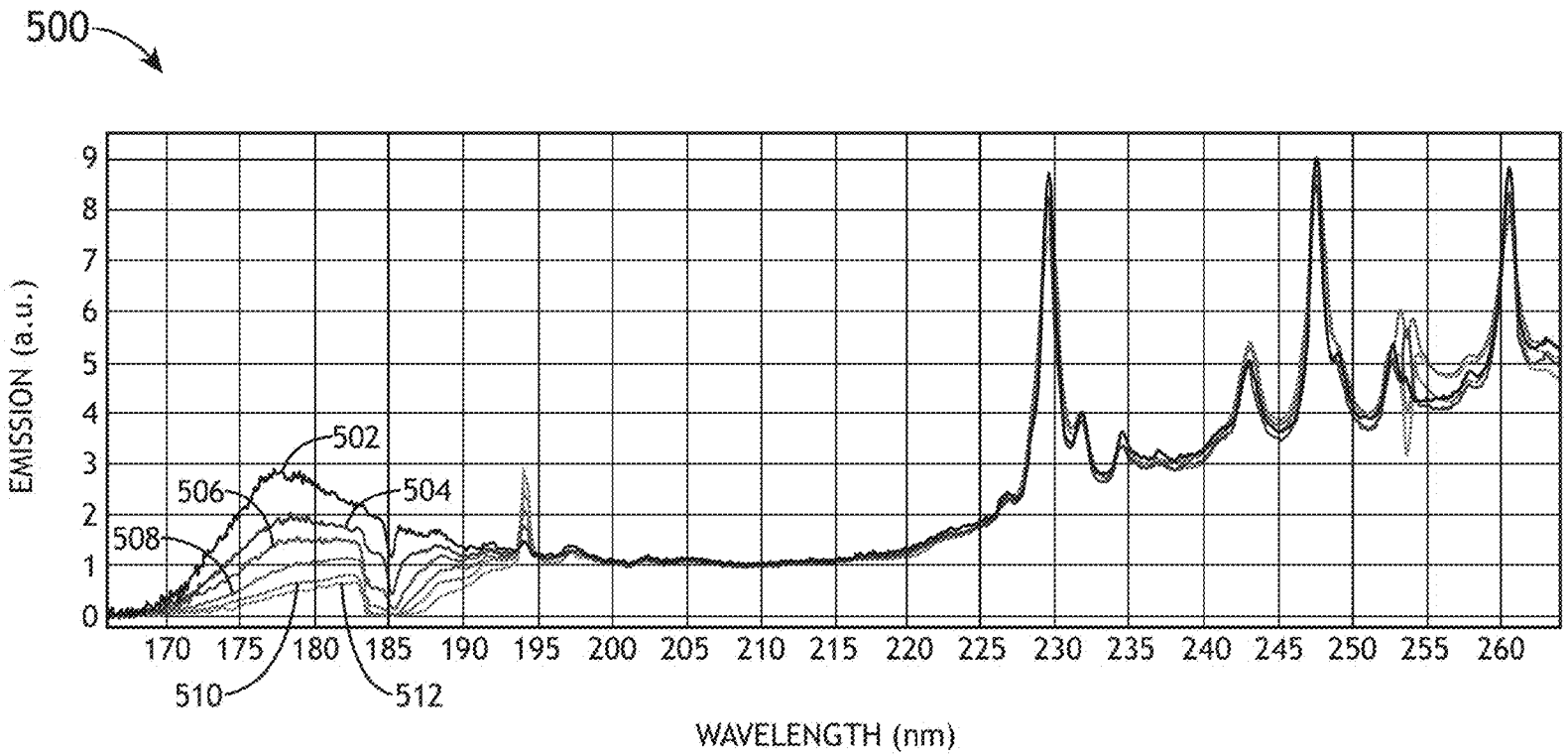
FIG. 5 is a plot illustrating the emission spectra of gas containment structures including xenon and varying concentrations of mercury, in accordance with one or more embodiments of the present disclosure.

FIG. 5 is a plot 500 illustrating the emission spectra 502-512 of gas containment structures 102 including xenon and varying concentrations of mercury, in accordance with one or more embodiments of the present disclosure.

In one embodiment, increasing the concentration of mercury in the range of 0.1 mg/cc (emission spectrum 502) to 1 mg/cc (emission spectrum 512) of a gas containment structure 102 containing xenon provides monotonically decreasing spectral power for wavelengths within a spectral band between 165 nm and 195 nm. Further, the concentration of mercury within this range may not significantly impact the relative spectral power of broadband radiation for wavelengths above 195 nm (e.g. from 195 nm to 265 nm as illustrated in FIG. 5). In this regard, the mercury may suppress (e.g. via absorption, quenching, or the like) select wavelengths of radiation and not suppress wavelengths of radiation in other spectral bands. Additionally, it may be the case that the spectral power associated the mercury of the gas mixture 103 may be relatively small relative to the spectral power associated with additional components of the gas mixture 103.

It is noted herein that the emission spectra of FIG. 5 and the corresponding descriptions are provided solely for illustrative purposes and should not be interpreted as limiting the present disclosure. For example, mercury with concentrations larger than 1 mg/cc may suppress select wavelengths of radiation. In one embodiment, a gas containment structure 102 includes xenon and 5 mg/cc of mercury for the suppression of select wavelengths of radiation (e.g. VUV radiation, or the like). As another example, a gas containment structure 102 may include additional gas components in addition to xenon and mercury. In one instance, a gas containment structure 102 may include xenon, mercury, and one or more additional noble gases (e.g. argon, neon, or the like).

In another embodiment, the gas mixture 103 includes argon, xenon, and mercury. In this regard, broadband radiation associated with argon of the gas mixture 103 (e.g. a plasma 104 or excimers formed at least in part using argon) may provide broadband radiation 115 for the system 100. Further, the xenon of the gas mixture 103 may suppress select wavelengths of radiation associated with the argon of the gas mixture 103. Additionally, the mercury of the gas mixture 103 may suppress select wavelengths of radiation associated with the argon and/or the xenon of the gas mixture 103. In this regard, the gas mixture 103 containing argon, xenon, and mercury may provide a LSP illumination source with high spectral power in desired spectral regions and low spectral power in undesired spectral regions. For example, the LSP illumination source including argon, xenon, and mercury as described herein may provide low spectral power for wavelengths that may be absorbed by or otherwise induce damage (e.g. solarization, or the like) components of the gas containment structure 102 (e.g. transparent portions 108, seals, flanges, or the like) or one or more additional components in the system 100.

It is noted herein that the description of a gas mixture 103 including three gas components is provided solely for illustrative purposes and should not be interpreted as limiting. For example, a gas mixture 103 may include any number of gas components to tailor the spectrum of radiation emanating from the gas mixture 103 (e.g. from the spatial extent of the gas mixture 103). In one instance, the gas mixture 103 includes a first gas component to provide broadband radiation, a second gas component to suppress selected wavelengths of radiation associated with the first gas component, a third gas component to suppress selected wavelengths of radiation associated with the first and/or second gas components, a fourth gas component to suppress selected wavelengths of radiation associated with the first, second, and/or third gas components, and so on. Further, any of the gas components of the gas mixture 103 may positively contribute to the spectral power of a desired spectral region.

Figure 1B:
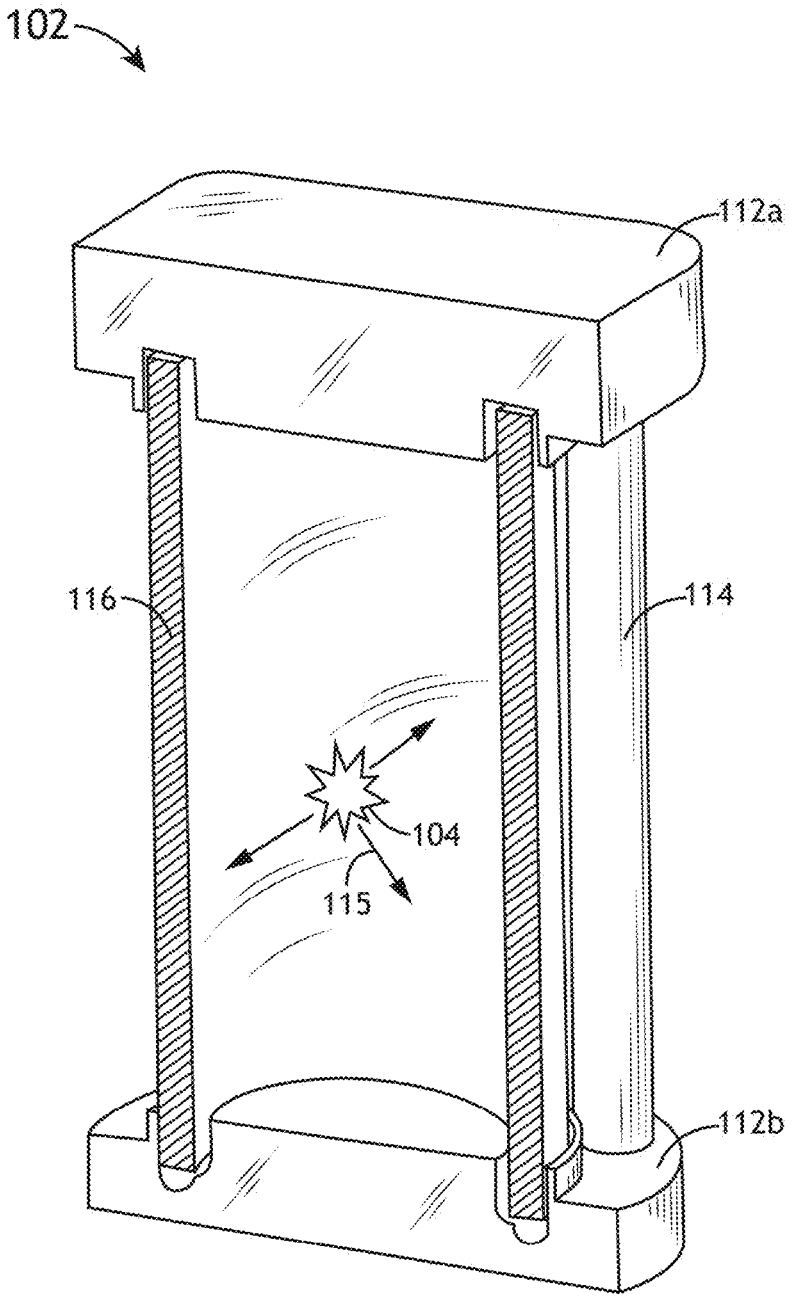
FIG. 1B is a conceptual view of a plasma cell for containing a gas mixture, in accordance with one embodiment of the present disclosure.

Referring again to FIGS. 1A through 1D, the gas containment structure 102 may include any type of gas containment structure 102 known in the art suitable for initiating and/or maintaining a plasma 104. In one embodiment, as shown in FIG. 1B, the gas containment structure 102 includes a plasma cell. In another embodiment, the transparent portion 108 includes a transmission element 116. In another embodiment, the transmission element 116 is a hollow cylinder suitable for containing a gas mixture 103. In another embodiment, the plasma cell includes one or more flanges 112*a*, 112*b* coupled to the transmission element 116. In another embodiment, the flanges 112*a*, 112*b* may be secured to the transmission element 116 (e.g., a hollow cylinder) using connection rods 114. The use of a flanged plasma cell is described in at least U.S. patent application Ser. No. 14/231,196, filed on Mar. 31, 2014; and U.S. Pat. No. 9,185,788, granted on Nov. 10, 2015, which are each incorporated previously herein by reference in the entirety.

Figure 1C:
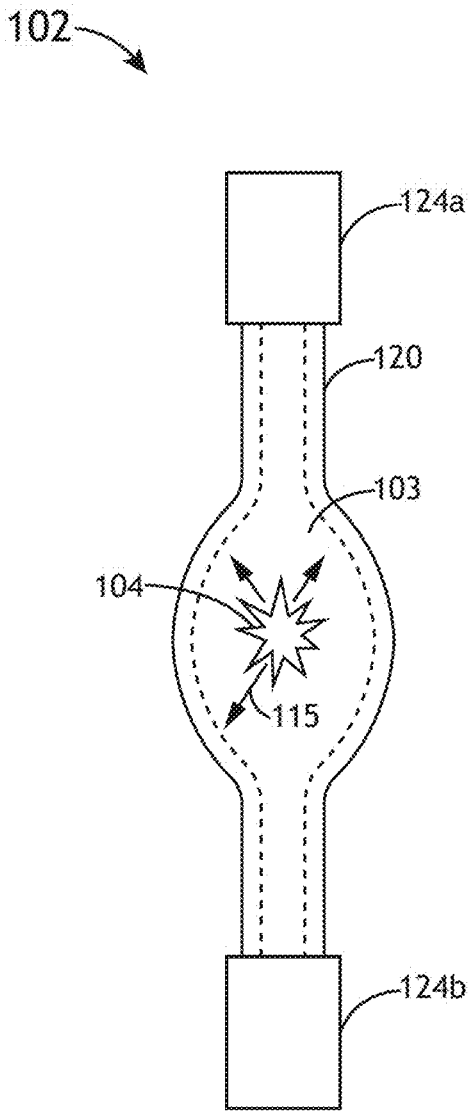
FIG. 1C is a conceptual view of a plasma bulb for containing a gas mixture, in accordance with one embodiment of the present disclosure.

In another embodiment, as shown in FIG. 1C, the gas containment structure 102 includes a plasma bulb. In another embodiment, the plasma bulb includes a transparent portion 120. In another embodiment, the transparent portion 120 of the plasma bulb is secured to gas supply assemblies 124*a*, 124*b* configured to supply gas to an internal volume of the plasma bulb. The use of a plasma bulb is described in at least in U.S. Pat. No. 7,786,455, granted on Aug. 31, 2010; and U.S. Pat. No. 9,318,311, granted on Apr. 19, 2016, which are each incorporated previously herein by reference in the entirety.

Figure 1D:
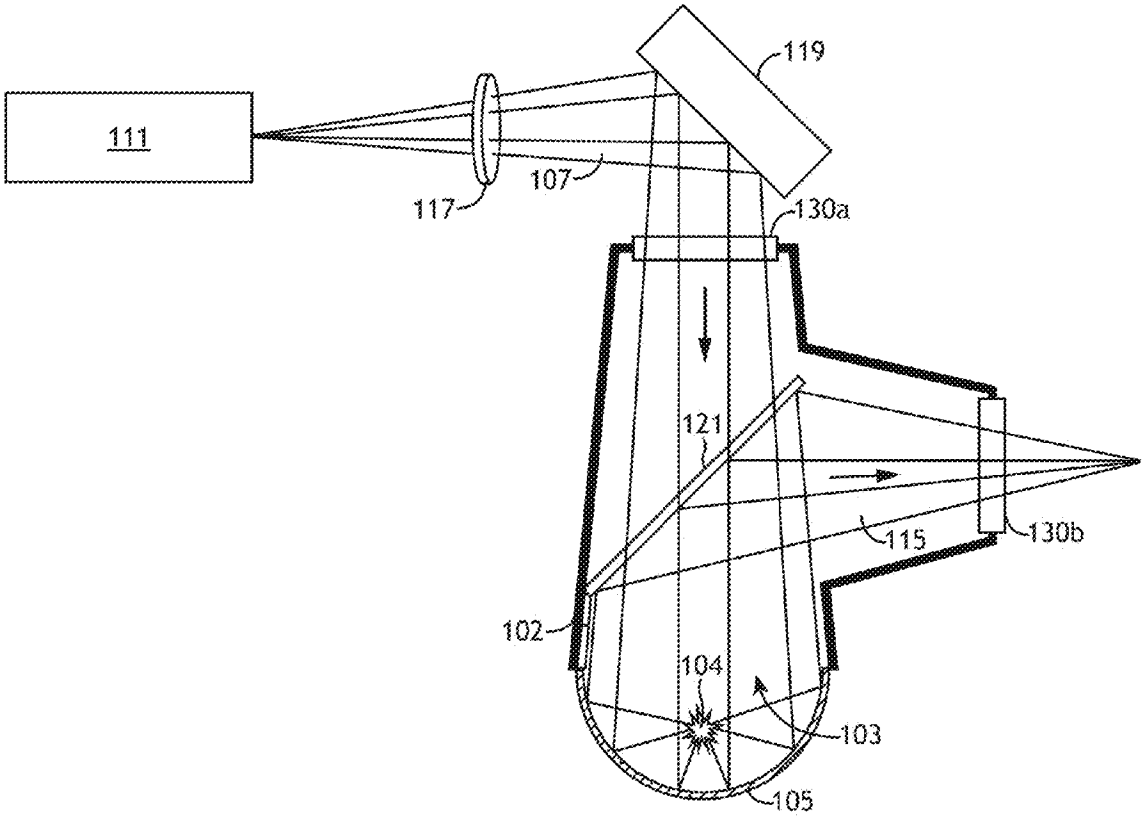
FIG. 1D is a conceptual view of a plasma chamber for containing a gas mixture, in accordance with one embodiment of the present disclosure.

It is noted herein that the various optical elements (e.g., illumination optics 117, 119, 121; collector element 105; and the like) may also be enclosed within the gas containment structure 102. In one embodiment, as shown in FIG. 1D, the gas containment structure 102 is a chamber suitable for containing a gas mixture 103 and one or more optical components. In one embodiment, the chamber includes the collector element 105. In another embodiment, one or more transparent portions 120 of the chamber include one or more transmission elements 130. In another embodiment, the one or more transmission elements 130 are configured as entrance and/or exit windows (e.g. 130*a*, 130*b* in FIG. 1D). The use of a self-contained gas chamber is described in U.S. Pat. No. 9,099,292, granted on Aug. 4, 2015, which is incorporated herein by reference in the entirety.

In another embodiment, the transparent portions 108 of the gas containment structure 102 (e.g., plasma cell plasma bulb, chamber and the like) may be formed from any material known in the art that is at least partially transparent to radiation generated by plasma 104. In one embodiment, the transparent portions 108 may be formed from any material known in the art that is at least partially transparent to IR radiation, visible radiation, and/or UV radiation 107 from the illumination source 111. In another embodiment, the transparent portions 108 may be formed from any material known in the art that is at least partially transparent to the broadband radiation 115 emitted from the plasma 104. In one embodiment, a gas containment structure 102 contains a gas mixture 103 including one or more gas components to suppress wavelengths of radiation corresponding to an absorption spectrum of any of the transparent portions of the gas containment structure 102. With regard to this embodiment, benefits of the inhibition of undesired wavelengths by the gas mixture 103 may include, but are not limited to, reduced damage, reduced solarization, or reduced heating of the transparent portion of the gas containment structure 102.

In some embodiments, the transparent portions 108 of the gas containment structure 102 may be formed from a low-OH content fused silica glass material. In other embodiments, the transparent portions 108 of the gas containment structure 102 may be formed from high-OH content fused silica glass material. For example, the transparent portion 108 of the gas containment structure 102 may include, but is not limited to, SUPRASIL 1, SUPRASIL 2, SUPRASIL 300, SUPRASIL 310, HERALUX PLUS, HERALUX-VUV, and the like. In other embodiments, the transparent portion 108 of the gas containment structure 102 may include, but is not limited to, CaF2, MgF2, LiF, crystalline quartz and sapphire. It is noted herein that materials such as, but not limited to, CaF2, MgF2, crystalline quartz and sapphire provide transparency to short-wavelength radiation (e.g., $\lambda<190$ nm). Various glasses suitable for implementation in the transparent portion 108 of the gas containment structure 102 (e.g., chamber window, glass bulb, glass tube or transmission element) of the present disclosure are discussed in detail in A. Schreiber et al., Radiation Resistance of Quartz Glass for VUV Discharge Lamps, J. Phys. D: Appl. Phys. 38 (2005), 3242-3250, which is incorporated herein by reference in the entirety. It is noted herein that fused silica does provide some transparency to radiation having wavelength shorter than 190 nm, showing useful transparency to wavelengths as short as 170 nm.

The transparent portion 108 of the gas containment structure 102 may take on any shape known in the art. In one embodiment, the transparent portion 108 may have a cylindrical shape, as shown in FIGS. 1A and 1B. In another embodiment, although not shown, the transparent portion may have a spherical shape. In another embodiment, although not shown, the transparent portion 108 may have a composite shape. For example, the shape of the transparent portion 108 may consist of a combination of two or more shapes. For instance, the shape of the transparent portion 108 may consist of a spherical center portion, arranged to contain the plasma 104, and one or more cylindrical portions extending above and/or below the spherical center portion, whereby the one or more cylindrical portions are coupled to one or more flanges 112.

The collector element 105 may take on any physical configuration known in the art suitable for focusing pump illumination 107 emanating from the illumination source 111 into the volume of gas mixture 103 contained within the transparent portion 108 of the gas containment structure 102. In one embodiment, as shown in FIG. 1A, the collector element 105 may include a concave region with a reflective internal surface suitable for receiving pump illumination 107 from the illumination source 111 and focusing the pump illumination 107 into the volume of gas mixture 103 contained within the gas containment structure 102. For example, the collector element 105 may include an ellipsoid-shaped collector element 105 having a reflective internal surface, as shown in FIG. 1A. As another example, the collector element 105 may include a spherical-shaped collector element 105 having a reflective internal surface.

In another embodiment, the collector element 105 collects broadband radiation 115 emitted by plasma 104 and directs the broadband radiation 115 to one or more downstream optical elements. For example, the one or more downstream optical elements may include, but are not limited to, a homogenizer 125, one or more focusing elements, a filter 123, a stirring mirror and the like. In another embodiment, the collector element 105 may collect broadband radiation 115 including EUV, DUV, VUV, UV, visible and/or infrared radiation emitted by plasma 104 and direct the broadband radiation to one or more downstream optical elements. In this regard, the gas containment structure 102 may deliver EUV, DUV, VUV, UV, visible, and/or infrared radiation to downstream optical elements of any optical characterization system known in the art, such as, but not limited to, an inspection tool or a metrology tool. For example, the LSP system 100 may serve as an illumination sub-system, or illuminator, for a broadband inspection tool (e.g., wafer or reticle inspection tool), a metrology tool or a photolithography tool. It is noted herein the gas containment structure 102 of system 100 may emit useful radiation in a variety of spectral ranges including, but not limited to, EUV, DUV radiation, VUV radiation, UV radiation, visible radiation, and infrared radiation.

In one embodiment, system 100 may include various additional optical elements. In one embodiment, the set of additional optics may include collection optics configured to collect broadband radiation 115 emanating from the plasma 104. For instance, the system 100 may include a cold mirror 121 (e.g. operating as a beamsplitter, a sampler, or the like) arranged to direct illumination from the collector element 105 to downstream optics, such as, but not limited to, a homogenizer 125.

In another embodiment, the set of optics may include one or more additional lenses (e.g., lens 117) placed along either the illumination pathway or the collection pathway of system 100. The one or more lenses may be utilized to focus pump illumination 107 from the illumination source 111 into the volume of gas mixture 103. Alternatively, the one or more additional lenses may be utilized to focus broadband radiation 115 emitted by the plasma 104 onto a selected target (not shown).

In another embodiment, the set of optics may include a turning mirror 119. In one embodiment, the turning mirror 119 may be arranged to receive pump illumination 107 from the illumination source 111 and direct the illumination to the volume of gas mixture 103 contained within the transparent portion 108 of the gas containment structure 102 via collection element 105. In another embodiment, the collection element 105 is arranged to receive illumination from tuning mirror 119 and focus the illumination to the focal point of the collection element 105 (e.g., ellipsoid-shaped collection element), where the transparent portion 108 of the gas containment structure 102 is located.

In another embodiment, the set of optics may include one or more filters 123. In another embodiment, one or more filters 123 are placed prior to the gas containment structure 102 to filter pump illumination 107. In another embodiment, one or more filters 123 are placed after the gas containment structure 102 to filter radiation emitted from the gas containment structure 102.

In another embodiment, the illumination source 111 is adjustable. For example, the spectral profile of the output of the illumination source 111 may be adjustable. In this regard, the illumination source 111 may be adjusted in order to emit a pump illumination 107 of a selected wavelength or wavelength range. It is noted that any adjustable illumination source 111 known in the art is suitable for implementation in the system 100. For example, the adjustable illumination source 111 may include, but is not limited to, one or more adjustable wavelength lasers.

In another embodiment, the illumination source 111 of system 100 may include one or more lasers. In a general sense, the illumination source 111 may include any laser system known in the art. For instance, the illumination source 111 may include any laser system known in the art capable of emitting radiation in the infrared, visible or ultraviolet portions of the electromagnetic spectrum. In one embodiment, the illumination source 111 may include a laser system configured to emit continuous wave (CW) laser radiation. For example, the illumination source 111 may include one or more CW infrared laser sources. For example, in settings where the gas mixture 103 is or includes argon, the illumination source 111 may include a CW laser (e.g., fiber laser or disc Yb laser) configured to emit radiation at 1069 nm. It is noted that this wavelength fits to a 1068 nm absorption line in argon and as such is particularly useful for pumping argon gas. It is noted herein that the above description of a CW laser is not limiting and any laser known in the art may be implemented in the context of the present disclosure.

In another embodiment, the illumination source 111 may include one or more diode lasers. For example, the illumination source 111 may include one or more diode laser emitting radiation at a wavelength corresponding with any one or more absorption lines of the species of the gas mixture 103 contained within the gas containment structure 102. In a general sense, a diode laser of the illumination source 111 may be selected for implementation such that the wavelength of the diode laser is tuned to any absorption line of any plasma (e.g., ionic transition line) or any absorption line of the plasma-producing gas (e.g., highly excited neutral transition line) known in the art. As such, the choice of a given diode laser (or set of diode lasers) will depend on the type of gas contained within the gas containment structure 102 of system 100.

In another embodiment, the illumination source 111 may include an ion laser. For example, the illumination source 111 may include any noble gas ion laser known in the art. For instance, in the case of an argon-based plasma, the illumination source 111 used to pump argon ions may include an Ar+ laser.

In another embodiment, the illumination source 111 may include one or more frequency converted laser systems. For example, the illumination source 111 may include a Nd:YAG or Nd:YLF laser having a power level exceeding 100 Watts. In another embodiment, the illumination source 111 may include a broadband laser. In another embodiment, the illumination source 111 may include one or more lasers configured to provide laser light at substantially a constant power to the plasma 104. In another embodiment, the illumination source 111 may include one or more modulated lasers configured to provide modulated laser light to the plasma 104. In another embodiment, the illumination source 111 may include one or more pulsed lasers configured to provide pulsed laser light to the plasma 104.

In another embodiment, the illumination source 111 may include one or more non-laser sources. In a general sense, the illumination source 111 may include any non-laser light source known in the art. For instance, the illumination source 111 may include any non-laser system known in the art capable of emitting radiation discretely or continuously in the infrared, visible or ultraviolet portions of the electromagnetic spectrum.

It is noted herein that the set of optics of system 100 as described above and illustrated in FIGS. 1A through 1D are provided merely for illustration and should not be interpreted as limiting. It is anticipated that a number of equivalent optical configurations may be utilized within the scope of the present disclosure.

Figure 6:
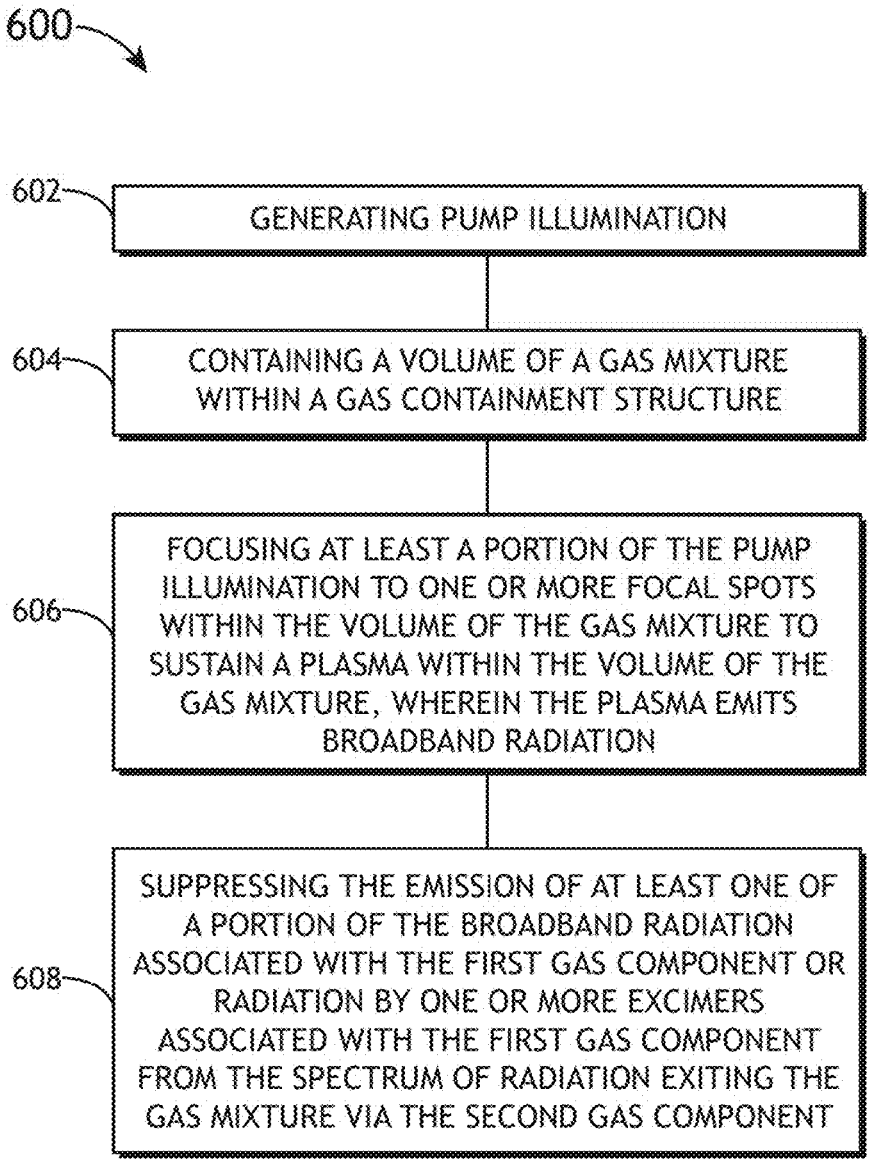
FIG. 6 is a flow diagram depicting a method for generating laser-sustained plasma radiation, in accordance with one or more embodiments of the present disclosure.

FIG. 6 is a flow diagram depicting a method 600 for generating laser-sustained plasma radiation, in accordance with one or more embodiments of the present disclosure. Applicant notes that the embodiments and enabling technologies described previously herein in the context of system 100 should be interpreted to extend to method 600. It is further noted, however, that the method 600 is not limited to the architecture of system 100. For example, it is recognized that at least a portion of the steps of method 600 may be carried out utilizing a plasma cell equipped with a plasma bulb.

In one embodiment, the method 600 includes a step 602 of generating pump illumination. For example, the pump illumination may be generated using one or more lasers.

In another embodiment, the method 600 includes a step 604 of containing a volume of a gas mixture within a gas containment structure. The gas containment structure may include any type of gas containment structure such as, but not limited to, a plasma lamp, a plasma cell, or a chamber. Further, the gas mixture may include a first gas component and a second gas component. In one embodiment, the gas mixture includes argon as a first gas component and xenon as a second gas component.

In another embodiment, the method 600 includes a step 606 of focusing at least a portion of the pump illumination to one or more focal spots within the volume of the gas mixture to sustain a plasma within the volume of the gas mixture. For example, the pump illumination may excite one or more species of the components of the gas mixture into a plasma state such that the excited species may emit radiation upon relaxation from the excited state. Further, one or more bound excimer states may be generated from components of the gas mixture (e.g. away from the plasma in regions of the gas mixture at temperatures suitable for excimer formation) that may emit radiation upon relaxation from the excimer state. In this regard, a spectrum of broadband radiation may emanate from the spatial extent of the gas mixture.

In another embodiment, the method 600 includes a step 608 of suppressing the emission of at least one of a portion of the broadband radiation associated with the first gas component or radiation by one or more excimers associated with the first gas component from the spectrum of radiation exiting the gas mixture via the second gas component. For example, the second gas component may absorb radiation emitted by the plasma containing species of the first gas component such that the spectral power of the absorbed radiation is reduced through propagation from the plasma to the spatial extent of the gas mixture (e.g. a transparent portion of a gas containment structure, or the like). By way of another example, the second gas component may suppress the radiative emission of excimers associated with the first gas component via any process such as, but not limited to collisional dissociation, a photolytic processes, or a resonant energy transfer process.

In another embodiment, the gas mixture may include a third gas component to suppress select wavelengths of radiation associated with either the first and/or the second gas components from exiting the gas mixture. For example, the third gas component may suppress select wavelengths of broadband radiation emitted by the plasma formed at least in part from species of the second gas component. By way of another example, the third gas component may suppress the radiation emission of excimers associated with the second gas component. In this regard, secondary effects associated with the second gas component (e.g. contributions to the spectral power of undesired spectral regions, or the like), may be mitigated by the third gas component.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected", or "coupled", to each other to achieve the desired functionality, and any two components capable of being so associated can also be viewed as being "couplable", to each other to achieve the desired functionality. Specific examples of couplable include but are not limited to physically interactable and/or physically interacting components and/or wirelessly interactable and/or wirelessly interacting components and/or logically interactable and/or logically interacting components.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. A system for forming a laser-sustained plasma, comprising:

a gas containment element, wherein the gas containment element is configured to contain a volume of a gas mixture, wherein the gas mixture includes a first gas component and a second gas component;

an illumination source configured to generate pump illumination; and a collector element configured to focus the pump illumination from the pumping source into the volume of the gas mixture in order to generate a plasma within the volume of the gas mixture, wherein the plasma emits broadband radiation, wherein the second gas component suppresses at least one of a portion of the broadband radiation associated with the first gas component or radiation by one or more excimers associated with the first gas component from a spectrum of radiation exiting the gas mixture.

2. The system of claim 1, wherein the second gas component suppresses radiation including wavelengths within an absorption spectrum of one or more propagation elements from the spectrum of radiation exiting the gas mixture.

3. The system of claim 2, wherein the one or more propagation elements comprise:

at least one of the collector element, a transmission element, a reflective element, or a focusing element.

4. The system of claim 2, wherein the one or more propagation elements are formed from at least one of crystalline quartz, sapphire, fused silica, calcium fluoride, lithium fluoride, or magnesium fluoride.

5. The system of claim 1, wherein the gas mixture suppresses radiation including wavelengths within an absorption spectrum of one or more additional elements from the spectrum of radiation exiting the gas mixture.

6. The system of claim 5, wherein the one or more additional elements comprise:

at least one of a flange or a seal.

7. The system of claim 1, wherein the broadband radiation emitted by the plasma includes at least one of infrared wavelengths, visible wavelengths, UV wavelengths, DUV wavelengths, VUV wavelengths, or EUV wavelengths.

8. The system of claim 1, wherein the second gas component suppresses a portion of the broadband radiation by the plasma associated with the first gas component including VUV wavelengths from the spectrum of radiation exiting the gas mixture.

9. The system of claim 1, wherein the second gas component suppresses a portion of the broadband radiation of the plasma associated with the first gas component including wavelengths lower than 600 nm from the spectrum of radiation exiting the gas mixture.

10. The system of claim 1, wherein the second gas component absorbs the at least one of a portion of the broadband radiation associated with the first gas component or radiation by one or more excimers associated with the first gas component.

11. The system of claim 1, wherein the second gas component quenches radiative emission by excimers associated with the first gas component.

12. The system of claim 11, wherein the second gas component quenches radiative emission of excimers associated with the first gas component by at least one of collisional dissociation, a photolytic process, or resonant energy transfer.

13. The system of claim 1, wherein the second gas component comprises:

less than 25% of the gas mixture.

14. The system of claim 13, wherein the second gas component comprises:

0.5% to 20% of the gas mixture.

15. The system of claim 13, wherein the second gas component comprises:

less than 5% of the gas mixture.

16. The system of claim 13, wherein the second gas component comprises:

10% to 15% of the gas mixture.

17. The system of claim 1, wherein the gas mixture further includes a third gas component, wherein the third gas component suppresses at least one of a portion of the broadband radiation associated with the second gas component or radiation by one or more excimers associated with the second gas component from the spectrum of radiation exiting the gas mixture.

18. The system of claim 17, wherein the third gas component comprises:

less than 5 mg per cubic centimeter of the gas mixture.

19. The system of claim 18, wherein the third gas component comprises:

less than 2 mg per cubic centimeter of the gas mixture.

20. The system of claim 17, wherein the first gas component comprises:

argon.

21. The system of claim 20, wherein the second gas component comprises:

xenon.

22. The system of claim 21, wherein the third gas component comprises:

mercury.

23. The system of claim 1, wherein the gas containment element includes at least one of a chamber, a plasma bulb or a plasma cell.

24. The system of claim 1, wherein the collector element is arranged to collect at least a portion of the broadband radiation emitted by the plasma and direct the broadband radiation to one or more additional optical elements.

25. The system of claim 1, wherein suppressing radiation from the spectrum of radiation exiting the gas mixture inhibits damage to one or more components of the system.

26. The system of claim 25, wherein the damage includes solarization.

27. The system of claim 1, wherein the illumination source comprises:

one or more lasers.

28. The system of claim 27, wherein the one or more lasers comprise:

one or more infrared lasers.

29. The system of claim 27, wherein the one or more lasers comprise:

at least one of a diode laser, a continuous wave laser, or a broadband laser.

30. The system of claim 1, wherein the illumination source comprises:

an illumination source configured to emit pump illumination at a first wavelength and illumination at an additional wavelength different from the first wavelength.

31. The system of claim 1, wherein the illumination source comprises:

an adjustable illumination source, wherein a wavelength of the pump illumination emitted by the illumination source is adjustable.

32. The system of claim 1, wherein the collector element is positioned external to the gas containment element.

33. The system of claim 1, wherein the collector element is positioned internal to the gas containment element.

34. The system of claim 1, wherein the collector element comprises:

at least one of an ellipsoid-shaped collector element or a spherical-shaped collector element.

35. A plasma lamp for forming a laser-sustained plasma, comprising:

a gas containment element, wherein the gas containment element is configured to contain a volume of a gas mixture, wherein the gas mixture includes a first gas component and a second gas component, wherein the gas mixture is further configured to receive pump illumination in order to generate a plasma within the volume of the gas mixture, wherein the plasma emits broadband radiation, wherein the second gas component suppresses at least one of a portion of the broadband radiation associated with the first gas component or radiation by one or more excimers associated with the first gas component from a spectrum of radiation exiting the gas mixture.

36. The system of claim 35, wherein the broadband radiation emitted by the plasma includes at least one of infrared wavelengths, visible wavelengths, UV wavelengths, DUV wavelengths, VUV wavelengths, or EUV wavelengths.

37. The system of claim 35, wherein the second gas component suppresses a portion of the broadband radiation by the plasma associated with the first gas component including VUV wavelengths from the spectrum of radiation exiting the gas mixture.

38. The system of claim 35, wherein the second gas component suppresses a portion of the broadband radiation of the plasma associated with the first gas component including wavelengths lower than 600 nm from the spectrum of radiation exiting the gas mixture.

39. The system of claim 35, wherein the second gas component absorbs the at least one of a portion of the broadband radiation associated with the first gas component or radiation by one or more excimers associated with the first gas component.

40. The system of claim 35, wherein the second gas component quenches radiative emission of excimers associated with the first gas component.

41. The system of claim 40, wherein the second gas components substantially quenches radiative emission of excimers associated with the first gas component by at least one of collisional dissociation, a photolytic process, or resonant energy transfer.

42. The system of claim 35, wherein the second gas component comprises:

less than 25% of the gas mixture.

43. The system of claim 42, wherein the second gas component comprises:

0.5% to 20% of the gas mixture.

44. The system of claim 42, wherein the second gas component comprises:

less than 5% of the gas mixture.

45. The system of claim 42, wherein the second gas component comprises:

10% to 15% of the gas mixture.

46. The system of claim 35, wherein the gas mixture further includes a third gas component, wherein the third gas component suppresses at least one of a portion of the broadband radiation associated with the second gas component or radiation by one or more excimers associated with the second gas component from the spectrum of radiation exiting the gas mixture.

47. The system of claim 46, wherein the third gas component comprises:

less than 5 mg per cubic centimeter of the gas mixture.

48. The system of claim 47, wherein the third gas component comprises:

less than 2 mg per cubic centimeter of the gas mixture.

49. The system of claim 46, wherein the first gas component comprises:

argon.

50. The system of claim 49, wherein the second gas component comprises:

xenon.

51. The system of claim 50, wherein the third gas component comprises:

mercury.

52. The system of claim 35, wherein the second gas component suppresses radiation including wavelengths within an absorption spectrum of a transmission element of the plasma lamp from the spectrum of radiation exiting the gas mixture.

53. The system of claim 52, wherein the transmission element of the plasma lamp is formed from at least one of crystalline quartz, sapphire, fused silica, calcium fluoride, lithium fluoride, or magnesium fluoride.

54. The system of claim 52, wherein suppressing radiation from the spectrum of radiation exiting the gas mixture inhibits damage to the transmission element of the plasma lamp.

55. The system of claim 54, wherein the damage includes solarization.

56. The system of claim 52, wherein the second gas component suppresses radiation including wavelengths within an absorption spectrum of the transmission element of the plasma lamp from the spectrum of radiation exiting the gas mixture.

57. A method for generating laser-sustained plasma radiation, comprising:

generating pump illumination;

containing a volume of a gas mixture within a gas containment structure, wherein the gas mixture includes a first gas component and a second gas component;

focusing at least a portion of the pump illumination to one or more focal spots within the volume of the gas mixture to sustain a plasma within the volume of the gas mixture, wherein the plasma emits broadband radiation; and suppressing the emission of at least one of a portion of the broadband radiation associated with the first gas component or radiation by one or more excimers associated with the first gas component from the spectrum of radiation exiting the gas mixture via the second gas component.

58. The method of claim 57, wherein suppressing the emission of at least one of a portion of the broadband radiation associated with the first gas component or radiation by one or more excimers associated with the first gas component from the spectrum of radiation exiting the gas mixture via the second gas component comprises:

suppressing a portion of the broadband radiation associated with the first gas component including VUV wavelengths from the spectrum of radiation exiting the gas mixture via the second gas component.

59. The method of claim 57, wherein suppressing the emission of at least one of a portion of the broadband radiation associated with the first gas component or radiation by one or more excimers associated with the first gas component from the spectrum of radiation exiting the gas mixture via the second gas component comprises:

suppressing a portion of the broadband radiation associated with the first gas component including wavelengths lower than 600 nm from the spectrum of radiation exiting the gas mixture via the second gas component.

60. The method of claim 57, wherein suppressing the emission of at least one of a portion of the broadband radiation associated with the first gas component or radiation by one or more excimers associated with the first gas component from the spectrum of radiation exiting the gas mixture via the second gas component comprises:

absorbing the at least one of a portion of the broadband radiation associated with the first gas component or radiation by one or more excimers associated with the first gas component via the second gas component.

61. The method of claim 57, wherein suppressing the emission of at least one of a portion of the broadband radiation associated with the first gas component or radiation by one or more excimers associated with the first gas component from the spectrum of radiation exiting the gas mixture via the second gas component comprises:

quenching radiative emission of excimers associated with the first gas component via the second gas component.

62. The method of claim 61, wherein quenching radiative emission of excimers associated with the first gas component via the second gas component comprises:

quenching radiative emission of excimers associated with the first gas component by at least one of collisional dissociation, a photolytic process, or resonant energy transfer.

63. The method of claim 57, wherein the gas mixture further includes a third gas component, further comprising:

suppressing the emission of at least one of a portion of the broadband radiation associated with the second gas component or radiation by one or more excimers associated with the second gas component from the spectrum of radiation exiting the gas mixture via the third gas component.

64. A plasma lamp for forming a laser-sustained plasma, comprising:

a gas containment element, wherein the gas containment element is configured to contain a volume of a gas mixture, wherein the gas mixture includes argon and xenon, wherein the gas mixture is further configured to receive pump illumination in order to generate a plasma within the volume of the gas mixture, wherein the plasma emits broadband radiation, wherein the xenon of the gas mixture suppresses at least one of a portion of the broadband radiation associated with the argon of the gas mixture or radiation by one or more excimers associated with the argon of the gas mixture from a spectrum of radiation exiting the gas mixture.

65. The system of claim 64, wherein the broadband radiation emitted by the plasma includes at least one of infrared wavelengths, visible wavelengths, UV wavelengths, DUV wavelengths, VUV wavelengths, or EUV wavelengths.

66. The system of claim 64, wherein the xenon of the gas mixture suppresses a portion of the broadband radiation associated with the argon of the gas mixture including VUV wavelengths from the spectrum of radiation exiting the gas mixture.

67. The system of claim 64, wherein the xenon of the gas mixture suppresses a portion of the broadband radiation associated with the argon of the gas mixture including wavelengths lower than 600 nm from the spectrum of radiation exiting the gas mixture.

68. The system of claim 64, wherein the xenon of the gas mixture absorbs the at least one of a portion of the broadband radiation associated with the argon of the gas mixture or radiation by one or more excimers associated with the argon of the gas mixture.

69. The system of claim 64, wherein the xenon of the gas mixture quenches radiative emission of excimers associated with the argon of the gas mixture.

70. The system of claim 69, wherein the xenon of the gas mixture substantially quenches radiative emission of excimers associated with the argon of the gas mixture by at least one of collisional dissociation, a photolytic process, or resonant energy transfer.

71. The system of claim 64, wherein the xenon of the gas mixture comprises:

less than 25% of the gas mixture.

72. The system of claim 71, wherein the xenon of the gas mixture comprises:

0.5% to 20% of the gas mixture.

73. The system of claim 71, wherein the xenon of the gas mixture comprises:

less than 5% of the gas mixture.

74. The system of claim 71, wherein the xenon of the gas mixture comprises:

10% to 15% of the gas mixture.

75. The system of claim 64, wherein the gas mixture further includes mercury, wherein the mercury of the gas mixture suppresses the emission of at least one of a portion of the broadband radiation associated with the xenon of the gas mixture or radiation by one or more excimers associated with the xenon of the gas mixture from the spectrum of radiation exiting the gas mixture.

76. The system of claim 75, wherein the mercury of the gas mixture comprises:

less than 5 mg per cubic centimeter of the gas mixture.

77. The system of claim 76, wherein the mercury of the gas mixture comprises:

less than 2 mg per cubic centimeter of the gas mixture.

78. The system of claim 64, wherein the xenon of the gas mixture suppresses radiation including wavelengths within an absorption spectrum of a transmission element of the plasma lamp from the spectrum of radiation exiting the gas mixture.

79. The system of claim 78, wherein the transmission element of the plasma lamp is formed from at least one of crystalline quartz, sapphire, fused silica, calcium fluoride, lithium fluoride, or magnesium fluoride.

80. The system of claim 78, wherein suppressing radiation from the spectrum of radiation exiting the gas mixture inhibits damage to the transmission element of the plasma lamp.

81. The system of claim 80, wherein the damage includes solarization.

82. The system of claim 78, wherein the xenon of the gas mixture suppresses radiation including wavelengths within an absorption spectrum of the transmission element of the plasma lamp from the spectrum of radiation exiting the gas mixture.

* * * * *